US009926089B2

(12) United States Patent
Ageling

(10) Patent No.: US 9,926,089 B2
(45) Date of Patent: Mar. 27, 2018

(54) METHOD AND DEVICE FOR THE PRODUCTION OF A PACKAGED UNIT

(75) Inventor: Werner Ageling, Kleve (DE)

(73) Assignee: KHS GmbH, Dortmund (DE)

( * ) Notice: Subject to any disclaimer, the term of this patent is extended or adjusted under 35 U.S.C. 154(b) by 804 days.

(21) Appl. No.: 13/059,330

(22) PCT Filed: Oct. 8, 2009

(86) PCT No.: PCT/EP2009/007254

§ 371 (c)(1),
(2), (4) Date: Feb. 16, 2011

(87) PCT Pub. No.: WO2010/046037

PCT Pub. Date: Apr. 29, 2010

(65) Prior Publication Data

US 2011/0139664 A1 Jun. 16, 2011

(30) Foreign Application Priority Data

Oct. 22, 2008 (DE) ..... 10 2008 052 633

(51) Int. Cl.

| | |
|---|---|
| ***B65B 11/12*** | (2006.01) |
| ***B65B 11/48*** | (2006.01) |
| ***B65B 51/02*** | (2006.01) |
| ***B65B 53/02*** | (2006.01) |
| ***B65D 71/08*** | (2006.01) |

(52) U.S. Cl.

CPC ..... *B65B 11/12* (2013.01); *B65B 51/02* (2013.01); *B65B 53/02* (2013.01); *B65D 71/08* (2013.01)

(58) Field of Classification Search

CPC ..... B65B 11/06; B65B 11/10; B65B 11/105; B65B 11/12; B65B 11/48; B65B 7/04

USPC ..... 53/557, 434, 436, 147, 556, 203, 210, 53/387.1, 387.3, 387.4, 370.2, 370.7; 493/189

See application file for complete search history.

(56) References Cited

U.S. PATENT DOCUMENTS

| | | | | |
|---|---|---|---|---|
| 1,870,345 | A * | 8/1932 | Robert et al. | 53/370.3 |
| 2,697,474 | A * | 12/1954 | McGinley | 53/371.3 |
| 2,890,555 | A | 6/1959 | Hayseen | |
| 2,899,791 | A * | 8/1959 | Anderson | 53/371.3 |
| 2,916,865 | A * | 12/1959 | Anderson | 53/370.7 |
| 3,078,633 | A * | 2/1963 | Stromberg | B65B 11/12 53/370.6 |

(Continued)

FOREIGN PATENT DOCUMENTS

| | | |
|---|---|---|
| DE | 1479307 | 9/1966 |
| DE | 2237948 | 2/1974 |

(Continued)

*Primary Examiner* — Gloria R Weeks

(74) *Attorney, Agent, or Firm* — Occhiuti & Rohlicek LLP

(57) ABSTRACT

An apparatus for producing a packaged unit includes a separating device, a shrinking device, and a manipulation unit. The separating device separates out individual products from a product stream and combines them to form a product cluster. The shrinking device secures the product cluster on all sides by applying a shrink film wrapped around the product cluster in a way that forms at least one lateral opening before being shrunk on. The manipulation unit places the shrink film against the product cluster at least in the region of the lateral opening, thereby forming a closed surface in the form of a closure with overlapping fold regions.

17 Claims, 2 Drawing Sheets

(56) References Cited

U.S. PATENT DOCUMENTS 3,110,144 A * 11/1963 Johansen et al. ..... B65B 11/22 53/224
3,274,302 A 9/1966 Anderson et al.
3,481,107 A * 12/1969 Ingemar et al. ..... 53/543
3,543,480 A * 12/1970 Weeks ..... 53/210
3,545,165 A * 12/1970 Greenwell ..... 53/398
3,579,956 A * 5/1971 Hoffmann ..... B65B 5/06 53/207
3,600,872 A * 8/1971 Sharpnack ..... B65B 5/10 206/432
3,631,649 A * 1/1972 Close ..... B65B 11/48 198/426
3,660,961 A * 5/1972 Ganz ..... 53/398
3,695,426 A 10/1972 Engelsberger
3,713,269 A * 1/1973 Sato ..... 53/374.8
3,739,547 A 6/1973 Brevko et al.
3,763,629 A * 10/1973 Carlstrom ..... B65B 11/42 53/230
3,777,448 A * 12/1973 Howe ..... 53/477
3,807,288 A * 4/1974 Niepmann ..... 493/252
3,808,767 A * 5/1974 Reid ..... 53/442
3,834,525 A * 9/1974 Morgese et al. ..... 206/161
3,869,846 A 3/1975 Timmerbeil
3,895,476 A * 7/1975 Burns, III ..... 53/442
RE28,535 E * 9/1975 Ganz ..... 53/398
3,949,537 A * 4/1976 Jason ..... B65B 11/54 53/226
3,994,116 A * 11/1976 McCormick ..... B65B 9/026 53/228
4,060,959 A 12/1977 Fiedler et al.
4,214,419 A 7/1980 Allen et al.
4,313,290 A * 2/1982 Furuya ..... B65B 11/22 53/230
4,317,320 A * 3/1982 Nigrelli ..... 53/377.2
4,430,844 A * 2/1984 James ..... 53/450
4,553,668 A * 11/1985 James et al. ..... 206/391
4,662,148 A * 5/1987 Nilsson ..... 53/399
4,815,252 A 3/1989 Renard et al.
4,947,605 A 8/1990 Ramsey
5,038,549 A * 8/1991 Nordstrom ..... 53/447
5,065,856 A * 11/1991 Reid et al. ..... 198/419.3
5,129,518 A 7/1992 Tanakye et al.
5,152,124 A * 10/1992 Ishii ..... B65B 5/045 53/252
5,203,137 A * 4/1993 Tsukada et al. ..... 53/409
5,203,144 A * 4/1993 Gambetti ..... 53/465
5,228,273 A * 7/1993 Kovacs ..... 53/479
5,255,495 A * 10/1993 Kovacs ..... 53/504
5,299,406 A * 4/1994 Laury ..... 53/397
5,381,643 A * 1/1995 Kazaitis et al. ..... 53/415
5,450,708 A * 9/1995 Lashyro ..... 53/399
5,518,119 A * 5/1996 Takahashi ..... B32B 27/08 206/489
5,570,563 A * 11/1996 Focke ..... B65B 49/14 53/370.6
5,657,608 A * 8/1997 Parviainen et al. ..... 53/66
5,765,336 A * 6/1998 Neagle et al. ..... 53/201
5,890,348 A * 4/1999 Nutzi ..... B65B 7/08 53/372.5
5,934,047 A * 8/1999 Meyers ..... 53/543
6,050,056 A * 4/2000 Weisser ..... B65B 7/02 493/183
6,343,459 B1 * 2/2002 Seaward ..... B65B 31/06 53/370.6
6,474,041 B1 * 11/2002 Gambetti ..... 53/141
6,516,589 B1 * 2/2003 Draghetti ..... B29C 66/8226 53/376.7
6,640,522 B2 * 11/2003 Antoniazzi et al. ..... 53/466
7,155,876 B2 * 1/2007 VanderTuin et al. ..... 53/557
7,328,550 B2 * 2/2008 Floding et al. ..... 53/442
7,386,263 B2 6/2008 Stahuber
7,490,450 B2 * 2/2009 Stahlecker ..... B42C 7/00 412/17
7,503,153 B2 * 3/2009 De Matteis ..... B65B 11/10 53/223
7,797,913 B2 * 9/2010 Gorrieri et al. ..... 53/466
7,987,651 B2 * 8/2011 Beeland ..... B65B 27/125 493/156
8,424,272 B2 * 4/2013 Cerf ..... 53/413
8,549,823 B2 * 10/2013 Pipes et al. ..... 53/442
2006/0130433 A1 * 6/2006 Wilder ..... B29C 65/18 53/442
2008/0302067 A1 * 12/2008 De Oliveira ..... B29C 65/18 53/463
2009/0183467 A1 * 7/2009 Rapp ..... B65B 7/26 53/370.2
2010/0031608 A1 2/2010 Schilling

FOREIGN PATENT DOCUMENTS

| | | |
|---|---|---|
| DE | 3732536 | 4/1989 |
| DE | 10144287 | 4/2003 |
| DE | 102005024380 | 11/2006 |
| DE | 102006036590 | 2/2008 |
| EP | 0479498 | 4/1992 |
| EP | 0614610 | 9/1994 |
| EP | 1103465 | 5/2001 |
| GB | 1105735 | 3/1968 |
| GB | 1117173 | 6/1968 |
| GB | 1297217 | 11/1972 |
| GB | 2246548 | 2/1992 |
| JP | H03200557 | 9/1991 |
| JP | 8217179 | 8/1996 |
| JP | 8276956 | 10/1996 |
| WO | 03/022684 | 3/2003 |

* cited by examiner

Fig. 1
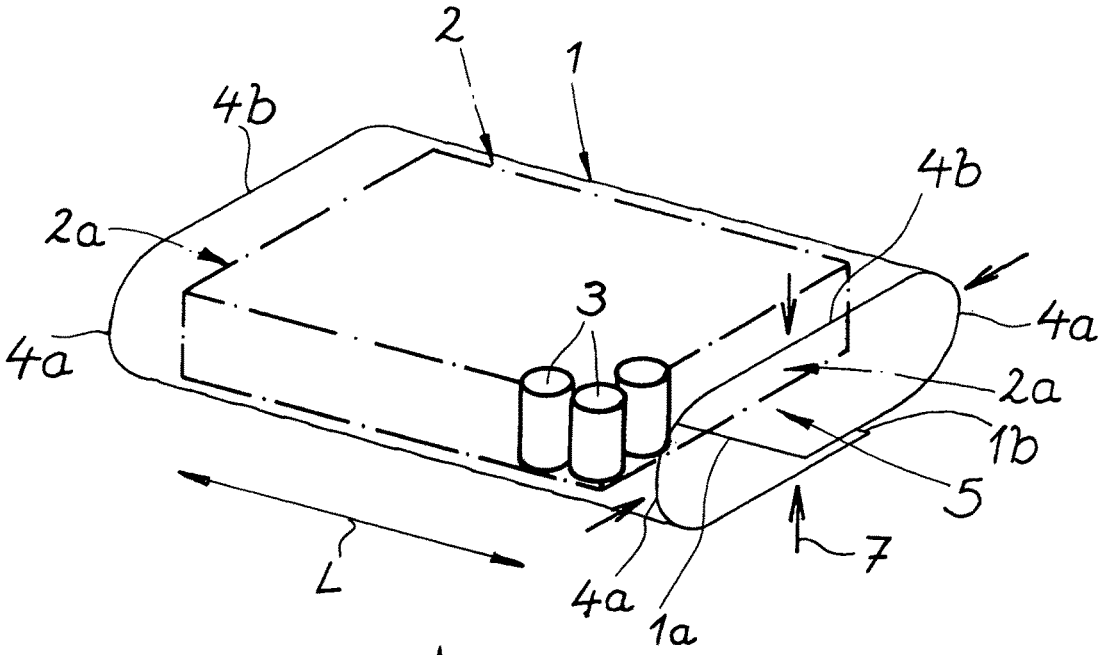
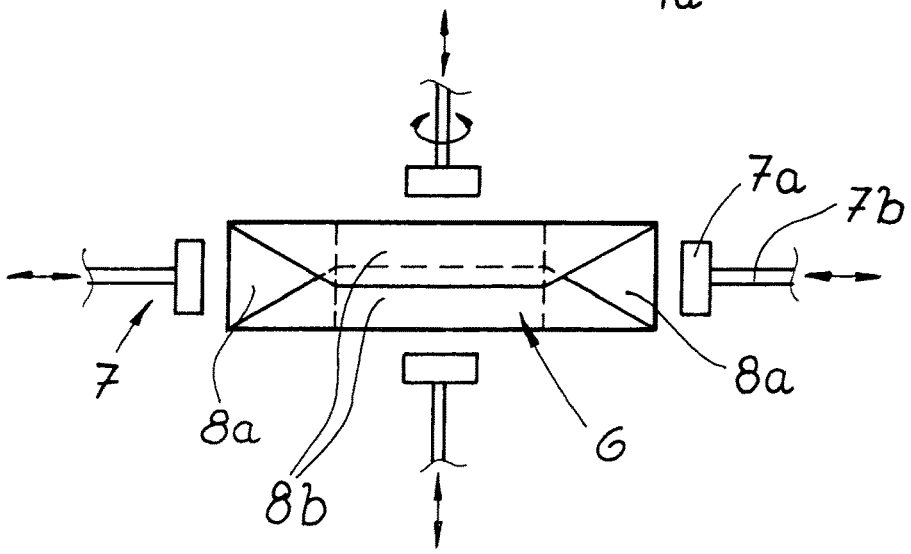
Fig. 2

METHOD AND DEVICE FOR THE PRODUCTION OF A PACKAGED UNIT

CROSS-REFERENCE TO RELATED APPLICATIONS

This application is the National Stage of International Application No. PCT/EP2009/007254, filed on Oct. 8, 2009, which claims the benefit of the priority date of German Patent Application No. 102008052633.9, filed on Oct. 22, 2008. The contents of both applications are hereby incorporated by reference in their entirety.

FIELD OF DISCLOSURE

The invention relates to shrink-wrapping a product cluster, and in particular, to eliminating the shrink eye in such shrink wrapping.

BACKGROUND

A method and an associated device for forming shrink packaging are known from DE 10 2006 036 590 A1. In this case, to form a group, the shrink film is wrapped around a group unit such that each group is surrounded at the top and at the bottom. On two oppositely situated sides the shrink film does not abut against the group, but rather protrudes from the group and consequently forms openings through which hot air passes into the group during the subsequent shrinking process. The size of the shrink film is reduced through the effect of hot air and/or heat on the shrink film.

Reducing the size of the shrink film causes it to abut tightly against the product group, thus causing to to be secured. However, shrink eyes remain as openings on the lateral faces. Because of these shrink eyes, the shrink wrap fails to completely protect the individual products of the finished package against unauthorized access.

The shrink eyes also have a negative effect of the stability of the packaging. To improve stability of a shrink-wrapped packaged unit, many packers insert stabilizers prior to shrink-wrapping. Examples of such stabilizers include cardboard bottoms, pads, or trays onto which the products are deposited and form the product cluster. Once the packaged unit assembled in this manner has been wrapped around with the shrink film, the necessary stability is achieved.

However, the depositing of the products onto a stabilizer requires an additional processing step. Additionally, the stabilizer must be supplied, which increases packaging costs that are ultimately passed on to a consumer. Finally, the stabilizer must be disposed of.

SUMMARY

The technical problem underlying the invention is to develop a method and a device for preparing a package for shrink-wrapping in a way that reduces or eliminates the shrink eye.

This invention solves the above problem by placing the shrink film against the product cluster at least in a region of lateral faces thereof, where prior art methods would create a shrink eye, to form a closure surface in the form of a closure with, where applicable, overlapping fold regions.

According to the invention, the shrink packaging or the cut of the shrink film is dimensioned such that it forms lateral protrusions beyond the product cluster. The protrusions are placed against the product clusters in the region of associated lateral faces. This means that the lateral protrusions are capable of generating a closed surface of the shrink film at the lateral faces of the product cluster such that the lateral faces that were formerly left at least partially open are closed. The method thus avoids shrink eye.

The lateral protrusions of the shrink film are placed against the surface of the product cluster at least on the region where a shrink eye would have been formed by earlier methods. The lateral protrusions disposed thereon form a closed surface. The shrink film can also be placed against other surfaces of the product cluster.

In some practices, placing the shrink film against the product cluster is carried out in a contactless manner, without using additional manipulation units. One way to do this is to electrostatically charge the shrink film. Such electrostatic charging is not difficult because the shrink film is advantageously a plastic shrink film, such as polyethylene. These types of plastic material films can easily be charged electrostatically, as described, in an exemplary and non-restricting manner, in DE 10 2005 024 380 A1 or also DE 101 44 287 A1, the contents of which are herein expressly incorporated by reference.

An electrostatically charged shrink film can easily be applied in a contactless manner, without the use of additional manipulation units, to the lateral faces of the product cluster in the region where the shrink eyes would have been had known methods been used. This secures the shrink film to this region.

As an alternative to the described contactless securing of the lateral protrusions to the lateral faces in the region of the opening, it is also possible to carry out the placement using one or more manipulation units that actually contact the film. Examples of manipulation units include guiding means, guide rods, run-up elements, and brushes. Using these manipulation units, the lateral protrusions of the shrink film can be placed against the product cluster with applicable overlapping fold regions.

The appearance of the shrink packaging can be improved in some applications when measures are taken to reliably prevent the finished and positioned shrink films from pushing or sliding together or pushing or sliding in relation to the product cluster.

It is also possible to select the electrostatic charging such that the obtainable adhesive strength between the overlapping shrink film or between the shrink film and the associated product cluster or the respective surrounding area reliably prevents undesired displacement of the shrink film.

In another embodiment or practice of the invention, the shrink film is secured by bonding together the overlapping regions and/or the overlapping fold regions of the shrink film. In some embodiments or practices of the invention, this is carried out by providing an adhesive coating on the shrink film. The adhesive coating is preferably applied in the region of the lateral protrusions from prior to wrapping or is applied once the product cluster has been wrapped. Another way to bond the shrink film by application of adhesive is to apply the adhesive onto the shrink film by injecting or spraying the adhesive.

In other embodiments or practices of the invention, the fold regions can be fused by the shrinking operation itself.

In some embodiments and practices of the invention, the shrink film is secured against the product cluster at least in the region of the lateral faces of the product cluster. This means that the lateral protrusions in the region of the lateral faces are not only actively placed against the product cluster but are additionally secured to the product cluster. Different types of securement can be used for this purpose.

In either case, whether adhesive or fusing is used, moving the lateral protrusions towards the lateral faces to be closed forms the overlapping fold regions. The adhesive present or introduced in the overlapping region or the action of fusing ensures that the individual folds can no longer be separated from each other.

A subsequent shrinking operation, for example in a shrink tunnel that uses hot air or heat radiation, contracts the shrink wrap, thereby eliminating any creases or waves in the shrink film. As a result, the shrink wrap fixedly surrounds the product cluster to form a group. The shrink eyes that were common on lateral faces of the product cluster are therefore no longer created. This means that the product cluster is totally encased and completely closed by the film. This means that the stability of a packaged unit is comparable to that obtained in the prior art with the combination of shrink eyes and stabilizers. The method and apparatus described herein thus eliminates the shrink eyes and the need for additional stabilizers or packaging reinforcement measures.

The method and apparatus of the invention thus eliminates or greatly reduces the need for reinforcing cardboard bottoms, introduced cardboard strips, and other stabilizers. Where these stabilizers are not rendered totally unnecessary, the required dimensions of these stabilizers are reduced, thus resulting in a cost saving.

The packaged unit produced according to the inventive method and using the inventive apparatus comprises the product cluster and the surrounding shrink film encasing it without any additional reinforcement. The stability of this packaged unit makes it easy to store or to transport. Any manipulation of the products when the products are displayed, for example, in a shop is almost completely prevented.

In some embodiments, the shrink film is wrapped around the product cluster with overlapping edges and is subsequently shrunk on. In many of these embodiments, the overlapping regions are the longitudinal edges because the shrink film is wrapped around the product cluster in its longitudinal direction. As a result, prior art methods would have left shrink eyes in the transverse direction of the product cluster. These shrink eyes are not present according to the invention.

One way to avoid shrink eyes is to have a pair of narrow side folds and a pair of broad side folds, both of which result from the lateral protrusions of the shrink film beyond the lateral faces. The narrow side folds are produced by placing the lateral protrusions of the shrink film wrapped around the product cluster on the narrow sides of the product cluster against those narrow sides. The broad side folds are produced by having the lateral protrusions on the wide sides of the product cluster be subjected to a similar placing operation. In some embodiments, suitable manipulation units place the associated narrow side protrusions and wide side protrusions against the associated side faces of the product cluster. Suitable manipulation units include guiding means, guide rods, run-on elements, and brushes.

When the manipulating unit is a brush, it is useful to provide a rotating brush and/or to mount the brush on a pivot arm that moves the brush.

As a rule, the broad side protrusions and the narrow side protrusions or the associated wide side folds are secured together to the narrow side folds. Associated and overlapping fold regions can be bonded together. However, the bonding step can be rendered unnecessary by instead using the shrinking operation to fuse the regions together.

In order to obtain this in detail, the narrow side folds are made before making the broad side folds. For this purpose, associated manipulation units or brushes initially place the narrow side protrusions against the corresponding lateral faces. The is followed by similar placement of the wide side protrusions or associated wide side folds.

It is preferable for the product cluster to be initially wrapped loosely by the shrink film, with the shrink film overlapping advantageously at its edges. Preferably, the shrink film overlaps at a longitudinal edge. In this way, during the subsequent shrinking operation, the shrink film avoids exposing any region of the product cluster. This results in a product that is encased over its entire surface.

In one aspect, the invention features an apparatus for producing a packaged unit. Such an apparatus includes a separating device, a shrinking device, and a manipulation unit. The separating device separates out individual products from a product stream and combines them to form a product cluster. The shrinking device secures the product cluster on all sides by applying a shrink film, wherein the shrink film is wrapped around the product cluster thereby forming at least one lateral opening before being shrunk on. The manipulation unit places the shrink film against the product cluster at least in the region of the lateral opening thereby forming a closed surface in the form of a closure with, where applicable, overlapping fold regions.

In some embodiments, the manipulation unit comprises a bonding device for placing the film in position in a contactless manner.

In other embodiments, the manipulation unit comprises at least one brush adapted to place laterally protruding ends of the shrink film against the product cluster in the region of the lateral opening with, where applicable, overlapping fold regions. Among these are embodiments that include three additional brushes, thereby providing a total of four brushes, each of which is assigned to operate on a corresponding lateral face of the product cluster.

In embodiments that have a brush, there can be a pivoting arm for rotating and moving the brush.

In yet other embodiments, the manipulation unit comprises an electrostatic charging unit for placing the shrink film in position in a contactless manner.

In another aspect the invention features an apparatus for receiving individual products that have been combined into a product cluster that has been loosely wrapped by shrink film in a way that forms at least one lateral opening. Such an apparatus includes a manipulation unit structured and configured for producing a packaged unit from the product cluster. The manipulation unit is configured to place the shrink film against the product cluster at least in a region of the lateral opening. Placement of the shrink film against the product cluster forms a closed surface thereon. After placement, the shrink film is shrunken on.

In some embodiments, the manipulation unit is structured and configured for bonding the film into position in a contactless manner.

In other embodiments, the apparatus also includes a brush adapted to place laterally protruding ends of the shrink film against the product cluster in the region of the lateral opening. Among these are embodiments in which the manipulation unit includes four brushes, each of which is assigned to operate on a corresponding lateral face of the product cluster.

In yet other embodiments, the manipulation unit includes a brush and a pivot arm. The brush is adapted to place laterally protruding ends of the shrink film against the product cluster in the region of the lateral opening. The pivot arm is configured for moving the brush. Among these embodiments are those in which the pivot arm is configured for moving the brush by rotating the brush about an axis defined by the pivot arm.

In yet other embodiments, the manipulation unit includes N brushes and N pivot arms and n is an integer between 1 and N inclusive. The $n^{th}$ pivot arm is configured to operate on an $n^{th}$ lateral face of the product cluster and also to move the $n_{th}$ brush. In a preferred embodiment, N=4.

In yet other embodiments, the manipulation unit includes N brushes and N pivot arms and n is an integer between 1 and N inclusive. The $n^{th}$ pivot arm is configured to operate on an $n^{th}$ lateral face of the product cluster and also to rotate the $n_{th}$ brush. In a preferred embodiment, N=4.

In additional embodiments, the manipulation unit is configured for electrostatic charging of the shrink film, thereby enabling placement of the shrink film in position in a contactless manner.

Also included are embodiments in which the manipulation unit includes a brush adapted to place laterally protruding ends of the shrink film against the product cluster in a region of the lateral opening with overlapping fold regions.

In yet another aspect, the invention features an apparatus for preparing a product cluster for shrink-wrapping. Such an apparatus includes a manipulation unit structured and configured for producing a packaged unit from the product cluster. The manipulation unit includes means for closing a lateral opening of shrink film on a product cluster that has been loosely wrapped with shrink film in such a way as to leave the lateral opening in the shrink film.

Among the embodiments are those in which the manipulation unit includes means for placing laterally protruding ends of the shrink film against the product cluster in the region of the lateral opening, and those in which the manipulation unit includes means for placing laterally multiple sets of protruding ends of the shrink film against corresponding multiple regions of the product clusters, wherein the multiple regions correspond to multiple lateral openings.

Yet other embodiments include those in which the manipulation unit includes means for placing laterally protruding ends of the shrink film against the product cluster in the region of the lateral opening, and means for moving the means for placing the laterally protruding ends. Among these are embodiments in which the means for placing the laterally protruding ends includes means for rotating the means for placing the laterally protruding ends.

BRIEF DESCRIPTION OF THE FIGURES

These and other features of the invention will be apparent from the following detailed description and the accompanying claims, in which:

FIG. 1 shows a packaged unit,

FIG. 2 shows an apparatus for preparing the package unit of FIG. 1 for shrink wrapping.

DETAILED DESCRIPTION

Figure 3:
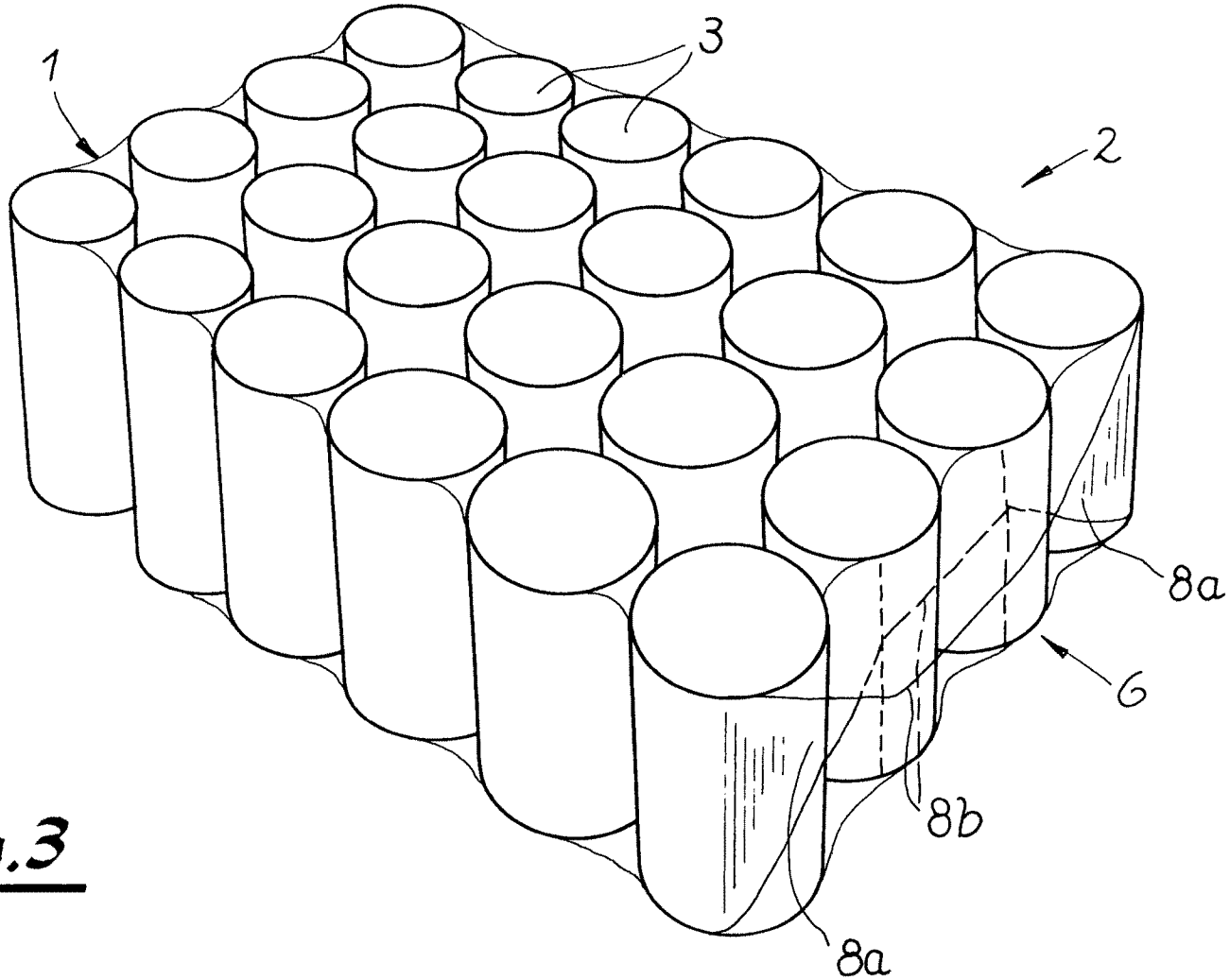
FIG. 3 shows a finished packaged.

FIG. 1 shows a packaged unit that comprises a shrink film 1 and a product cluster 2 that is encased by the shrink film 1. The product cluster 2 is formed from individual products 3 that are best seen in FIG. 3.

In the exemplary embodiment, the products 3 are cans. These cans can be beverage cans. Alternatively, the cans are rotationally symmetric and cylindrical containers. The containers can accommodate beverages, as well as foodstuffs. The products 3 are combined to form a packaged unit in the manner described below.

The products 3 are initially separated from a product stream by a separating device, which is conventional and therefore need not be shown. The products 3 are then combined to form the product cluster 2. During this process, they are aligned and compacted to the extent where they abut against each other. A shrink film 1 then secures the products 3 or the product cluster 2 so that packaged units that have been produced in this manner can be better stored and/or conveyed.

Initially, the shrink film 1 is loosely wrapped around the product cluster 2, as is shown in FIG. 1. Loosely wrapping the shrink film can be carried out by a winding machine, which is conventional and therefore need not be shown. In the case of this operation, the shrink film 1 is wrapped around the product cluster 2 such that respective edges 1*a*, 1*b* overlap, as can be seen in FIG. 1. In the exemplary embodiment the edges 1*a*, 1*b* are longitudinal edges 1*a*, 1*b* of the shrink film 1. However this configuration is only an example and is not limiting.

In the illustrated embodiment, the shrink film 1 is wrapped around the product cluster 2 in the longitudinal direction L such that the lateral faces 2*a* face the direction L. However, this is not mandatory.

A packaged unit formed in this manner has lateral protrusions 4*a*, 4*b* that protrude beyond an associated lateral face 2*a* of the product cluster. In this case, the lateral protrusions 4*a*, 4*b* of the shrink film 1 are dimensioned such that the shrink film 1 closes the lateral face 2*a* when the lateral protrusions 4*a*, 4*b* are placed against the lateral face 2*a* or the product cluster 2.

The shrink film 1 is initially wrapped in a hose-shaped manner around the product cluster 2, as shown in FIG. 1. When wrapped, the shrink film 1 forms an opening 5 that exposes the two lateral faces 2*a*. The opening 5 has only one closure 6, which is seen in FIG. 2.

The closure 6 is defined such that the shrink film 1 or its lateral protrusions 4*a*, 4*b* can be placed against the product cluster 2 in the region of the opening 5 thereby forming a closed surface. For this purpose, along with the aforementioned separating device and a conventional shrinking device placed at the end of the production path for the final mutual securing of the products 3 by way of the shrink film 1, an apparatus for producing a packaged unit has a plurality of manipulation elements 7, which are shown in FIG. 2, for producing the packaged unit shown in FIG. 3.

Each manipulation unit 7 has at least one brush 7*a* that is supported by a pivot arm 7*b*. In some embodiments, the brush 7*a* rotates about an axis defined by the pivot arm 7*b*. However, there are embodiments where this is not the case.

Using the brush 7*a* or the manipulation units 7, the lateral protrusions 4*a*, 4*b* of the shrink film 1 are placed against the product cluster 2 in the region of the opening 5. At the same time, overlapping fold regions 8*a*, 8*b*, as shown in FIG. 2, are formed. In one embodiment, there are four brushes 7*a*. This configuration is useful for block-shaped product clusters since there will then be one brush 7*a* per lateral face of the product cluster 2.

The lateral protrusions 4*a*, 4*b* include narrow side protrusions 4*a* and broad side protrusions 4*b*. The broad side protrusions 4*b* are placed against the lateral faces 2*a* by associated manipulation units 7 on the corresponding broad sides of the block-shaped product cluster 2. The fold regions 8*b* according to FIG. 2 in the exemplary embodiment are formed in this way.

The fold regions 8*b* corresponding to FIG. 2 may be secured or become secured to the lateral face 2*a* by the shrink film 1 having been completely charged electrostatically beforehand and the manipulation units 7 being responsible for moving the associated lateral protrusions nearer until they are attracted by the electrostatically charged lateral face 2*a*. As an alternative or in addition to this, it is also possible for the fold regions 8*b* to be bonded together, or bonded to the product cluster 2. The same is also true for the narrow protrusions 4*a* and the resultant fold regions 8*a*.

In each case, the placing of the narrow side protrusions 4*a* is carried out first such that initially the two associated narrow side folds 8*a* are placed against the lateral face 2*a* to be covered. The two broad side protrusions 4*b* are then placed against the lateral face 2*a* and there form the broad side folds 8*b*. In the case of this operation, the broad side folds 8*b* are connected to the narrow side folds 8*a*. This can be effected by having a conventional electrostatic unit carry out electrostatic charging of the shrink film 1 in its entirety or at least of the lateral protrusions 4*a*, 4*b* and/or by bonding the fold regions 8*a*, 8*b*.

After the described operations, the packaged unit corresponding to FIG. 2 is moved into a shrink tunnel or a comparable shrinking device in which the shrink film 1 is shrunken onto the product cluster 2. At the same time, the products are secured to each other because the size of the shrink film 1 is reduced during this operation.

As a result, the lateral faces that were formerly open due to the shrink eyes are covered by a closed surface through the interaction of the narrow side folds 8*a* and broad side folds 8*b*. The disclosed apparatus and its method of operation thus close the shrink eyes. The shrink film 1 therefore completely encases the product cluster 2 after the shrinking-on operation. As a result there is no express need to attach additional stabilizing elements such as, for example, cardboard covers, etc. This reduces the production costs and the expenditure.

As already represented, in the case of many other applications where additional stabilizing elements cannot be dispensed with entirely, the dimensions of the stabilizing elements can be reduced, for example the material thickness can be reduced, thereby producing a cost saving even in such applications.

The electrostatic charging of the shrink film 1 including at least the lateral protrusions 4*a*, 4*b* can be performed before, during, or after the described folding operation. This means that the narrow side folds 8*a* and broad side folds 8*b* can be electrostatically charged after their production as in FIG. 2 to prevent them coming unfolded again. In each case, the shrink film 1 remains in its position after the described operations, also, in particular in the region of the closure 6, and is also not displaced by a possible hot air fan in the interior of the shrink tunnel. This means that it is possible for the shrink film 1 to surround the product cluster without any gaps and, in particular, to also obtain a reliable closure 6 for the lateral faces that were formerly open.

Having described the invention, and a preferred embodiment thereof, what is claimed as new, and secured by Letters Patent is:

1. An apparatus for producing a packaged unit from a product cluster completely enclosed by at most one seamless piece of shrink film in a way that forms at least two lateral openings, each lateral opening defined by lateral protrusions that extend away from the product cluster, said apparatus comprising: a manipulation unit that comprises a first rotating arm that is configured to move a first element vertically relative to said product cluster to fold a first lateral protrusion of one of said lateral openings, and a second rotating arm that is configured to move a second element horizontally relative to said product cluster to fold a second lateral protrusion of said one lateral opening; wherein overlapping fold regions are formed by said folded first lateral protrusion and said folded second lateral protrusion; and a shrinking device that receives said product cluster after said manipulation unit has placed said shrink film against said product cluster in said overlapping fold region of said lateral opening.

2. The apparatus of claim 1, wherein said shrinking device comprises a shrink tunnel.

3. The apparatus of claim 1, wherein said manipulation unit comprises a bonding device for placing said shrink film in position in a contactless manner.

4. The apparatus of claim 1, wherein said manipulation unit places said shrink film, which has had adhesive applied thereto, in position in a contactless manner.

5. The apparatus of claim 1, wherein said manipulation unit comprises a bonding device for placing said shrink film in position in a contactless manner and wherein said bonding device fuses said film.

6. The apparatus of claim 1, wherein said first element comprises a brush adapted to place laterally protruding ends of said shrink film against said product cluster in said overlapping fold region of said lateral opening.

7. The apparatus of claim 1, wherein said first and second elements comprise brushes adapted to place laterally protruding ends of said shrink film against said product cluster in said overlapping fold region of said lateral opening, said manipulation unit further comprising two additional brushes, thereby providing a total of four brushes, each of which is assigned to operate on a corresponding lateral face of said shrink film product cluster, wherein each of said four brushes operates on a different lateral face.

8. The apparatus of claim 1, wherein said manipulation unit said shrink film, which has been electrostatically charged, in position in a contactless manner.

9. An apparatus for receiving individual products that have been combined into a product cluster loosely wrapped by at most one seamless piece of shrink film in a way that forms at least two lateral openings, each lateral opening defined by lateral protrusions that extend away from the product cluster, said apparatus comprising: a manipulation unit structured and configured for producing a packaged unit from said product cluster, wherein said manipulation unit comprises a first rotating arm that is configured to move a first element vertically from above said product cluster in a region of one of said at least two lateral openings and a second rotating arm that is configured to move a second element horizontally from a side of said product duster in said region of one of said at least two lateral openings, wherein said manipulation unit is configured to place said shrink film against said product duster in a region of each of said lateral openings, wherein placement of said shrink film against said product cluster completely encloses said product cluster such that no shrink eyes remain.

10. The apparatus of claim 9, wherein said manipulation unit is structured and configured for bonding said shrink film into position in a contactless manner.

11. The apparatus of claim 9, wherein said manipulation element comprises a brush adapted to place laterally protruding ends of said shrink film against said product cluster in said region of said lateral opening.

12. The apparatus of claim 9, wherein said manipulation unit further comprises a third rotating arm configured to move a third element and a fourth rotating arm configured to move a fourth element, each element being a brush, for a total of four brushes in said manipulation unit, each of which is assigned to operate on a corresponding lateral face of said product cluster in said region of one of said at least two lateral opening.

13. The apparatus of claim 9, wherein said rotating arms are configured for moving said brushes by rotating said brush respectively about an axis defined by said rotating arm.

14. The apparatus of claim 9, wherein said manipulation unit further comprises a third rotating arm configured to move a third element and a fourth rotating arm configured to move a fourth element, each element being a brush; wherein said element is configured to operate on a first lateral face of a lateral protrusion of said shrink film in a region of said one lateral opening, wherein said second element is configured to operate on a second lateral face of a lateral protrusion of said shrink film in a region of said one lateral opening, wherein said third element is configured to operate on a third lateral face of a lateral protrusion of said shrink film in a region of said one lateral opening, wherein said fourth element is configured to operate on a fourth lateral face of a lateral protrusion of said shrink film in a region of said one lateral opening.

15. The apparatus of claim 9, wherein said manipulation unit further comprises a third rotating arm configured to move a third element and a fourth rotating arm configured to move a fourth element, each element being a brush; wherein said first element is configured to operate on a first lateral face of a lateral protrusion of said shrink film in a region of said one lateral opening, wherein said second element is configured to operate on a second lateral face of a lateral protrusion of said shrink film in a region of said one lateral opening, wherein said third element is configured to operate on a third lateral face of a lateral protrusion of said shrink film in a region of said one lateral opening, wherein said fourth element is configured to operate on a fourth lateral face of a lateral protrusion of said shrink film in a region of said one lateral opening; wherein said first rotating arm is configured to move said first brush by rotating said first brush about an axis of said first rotating arm, wherein said second rotating arm is configured to move said second brush by rotating said first brush about an axis of said second rotating arm, wherein said third rotating arm is configured to move said third brush by rotating said first brush about an axis of said third rotating arm, and wherein said fourth rotating arm is configured to move said fourth brush by rotating said first brush about an axis of said fourth rotating arm.

16. The apparatus of claim 9, wherein said manipulation unit comprises an electrostatic charging unit for placing said shrink film in position in a contactless manner.

17. The apparatus of claim 9, wherein said manipulation unit comprises a brush adapted to place laterally protruding ends of said shrink film against said product cluster in said region of said lateral opening.

* * * * *